United States Patent [19]

Martin

[11] Patent Number: 4,523,869

[45] Date of Patent: Jun. 18, 1985

[54] SHEET FEEDER

[75] Inventor: Samuel W. Martin, Weston, Conn.

[73] Assignee: LQ Corporation, Meriden, Conn.

[21] Appl. No.: 527,014

[22] Filed: Aug. 29, 1983

[51] Int. Cl.[3] ..... B41J 13/10

[52] U.S. Cl. ..... 400/629; 400/636.2

[58] Field of Search ..... 400/636.2, 629; 101/228, 93; 271/264, DIG. 9

[56] References Cited

U.S. PATENT DOCUMENTS

| | | | |
|---|---|---|---|
| 3,134,323 | 5/1964 | Stelling, Jr. | 101/228 |
| 3,677,177 | 7/1972 | Smith, Jr. | 101/228 |
| 4,416,559 | 11/1983 | Steinhilber | 400/636.2 X |

FOREIGN PATENT DOCUMENTS

| | | | |
|---|---|---|---|
| 2910849 | 9/1980 | Fed. Rep. of Germany | 400/636.2 |

*Primary Examiner*—Edgar S. Burr
*Assistant Examiner*—John A. Weresh
*Attorney, Agent, or Firm*—Hayes & Reinsmith

[57] ABSTRACT

A sheet feeder is disclosed which may be used as an auxiliary unit with a computer controlled printer. The feeder features a mechanical timing mechanism which effects a start-to-feed function in synchronism with printer platen motion and which is driven by a mechanical interface with a printer platen drive gear to sequentially and precisely position individual paper sheets in start-to-print position in the computer controlled printer with no requirements for electrical power, software or electronic logic.

13 Claims, 9 Drawing Figures

SHEET FEEDER

FIELD OF THE INVENTION

This invention generally concerns paper handling apparatus and is specifically directed to a timing mechanism for a paper sheet feeder for automatically delivering individual sheets of paper from a stacked supply to a printing machine such as a computer controlled typewriter or word processor printer.

BACKGROUND OF THE INVENTION

A variety of different apparati for sequentially feeding discrete sheets of paper to a machine are known in the art. In addition to conventional manual feeding devices, apparati are known which semi-automatically feed paper to typewriters from a stacked supply such as illustrated in U.S. Pat. Nos. 4,067,566 and 4,222,557.

With the advent of automated office procedures with mini-computers performing word processing, computing and other functins, sophisticated paper feeders have been developed to conform with the requirements of existing impact printing equipment. These currently available paper feeders use photosensors to determine the position of paper in the print mechanism along with electric clutches and brakes to perform the necessary synchronizing function of placing print in the proper vertical positon on the paper. U.S. Pat. No. 4,326,815 is illustrative of such prior art.

Because of the expense of the electric components, some other paper feeders use elaborate mechanisms in cooperation with electronic controls to synchronize paper feeding. This is done by backing up the platen roller, and thus the paper drive gear, a certain number of steps in mechanically engaging or disengaging certain feed means according to the number of steps taken. In such devices, a page is printed and then fed out into a stacker after which the electronic logic is directed to reverse the platen roller a discrete number of steps and then to feed forward a discrete number of steps to position the next page in the proper vertical place. Although such apparatus has the advantage of being able to select among several paper bins, depending upon the number of backsteps, and all-mechanical interfacing, this type apparatus also has a disadvantage of requiring special software programming in either the word processing controller or the printer.

It is an object of this invention to provide a significantly simplified paper sheet feeder having the advantage of all-mechanical interfacing to a computer controlled typewriter or printer without requiring any special or customized software or hardware in either the printer or word processor to feed successive sheets at precisely the right time in synchronization with a controller of the word processor. A related object of this invention is to provide such a feeder with a minimum number of relatively inexpensive parts in an attactive compact unit particularly easy to install and operate and which is capable of reliable and extensive use under demanding conditions with minimum service requirements. In particular, it is a further object to provide such a feeder which has no electrical interface or power requirements but rather is provided a simplified mechanical interface to a driving gear on the printer platen shaft and has the capability of printing subscripts, superscripts and plotting while additionally permitting manual single sheet or envelope bypass and eliminating page to page accumulated error. A related aim of this invention is to provide such a feeder capable of being "backed up" without encountering mechanical lock-up problems.

Other objects will be in part obvious and in part pointed out in more detail hereinafter.

SUMMARY OF THE INVENTION

In accordance with this invention, a mechanical timing mechanism is provided to synchronize sequential feeding of individual paper sheets into word processing typewriters or printers with a "top of page" or "top of form" cycle of the electronics. Sheet engaging feed means is provided upstrean of a word processor printer. Power operated drive means are provided downstream of the feed means in a paper feed path from a paper storage hopper to a word processor printer. The power operated drive means is drivingly connected to the feed means for operating the feed means. The drive means includes timing means for intermittently actuating operation of the feed means responsive to uninterrupted power operation of the drive means for sequentially driving individual paper sheets a preselected distance in one direction along the paper feed path.

A better understanding of the objects, advantages, features, properties and relations of this invention will be obtained from the following detailed description and accompanying drawings which set forth an illustrative embodiment and are indicative of the various ways in which the principle of this invention is employed.

DETAILED DESCRIPTION OF A PREFERRED EMBODIMENT

Figure 1:
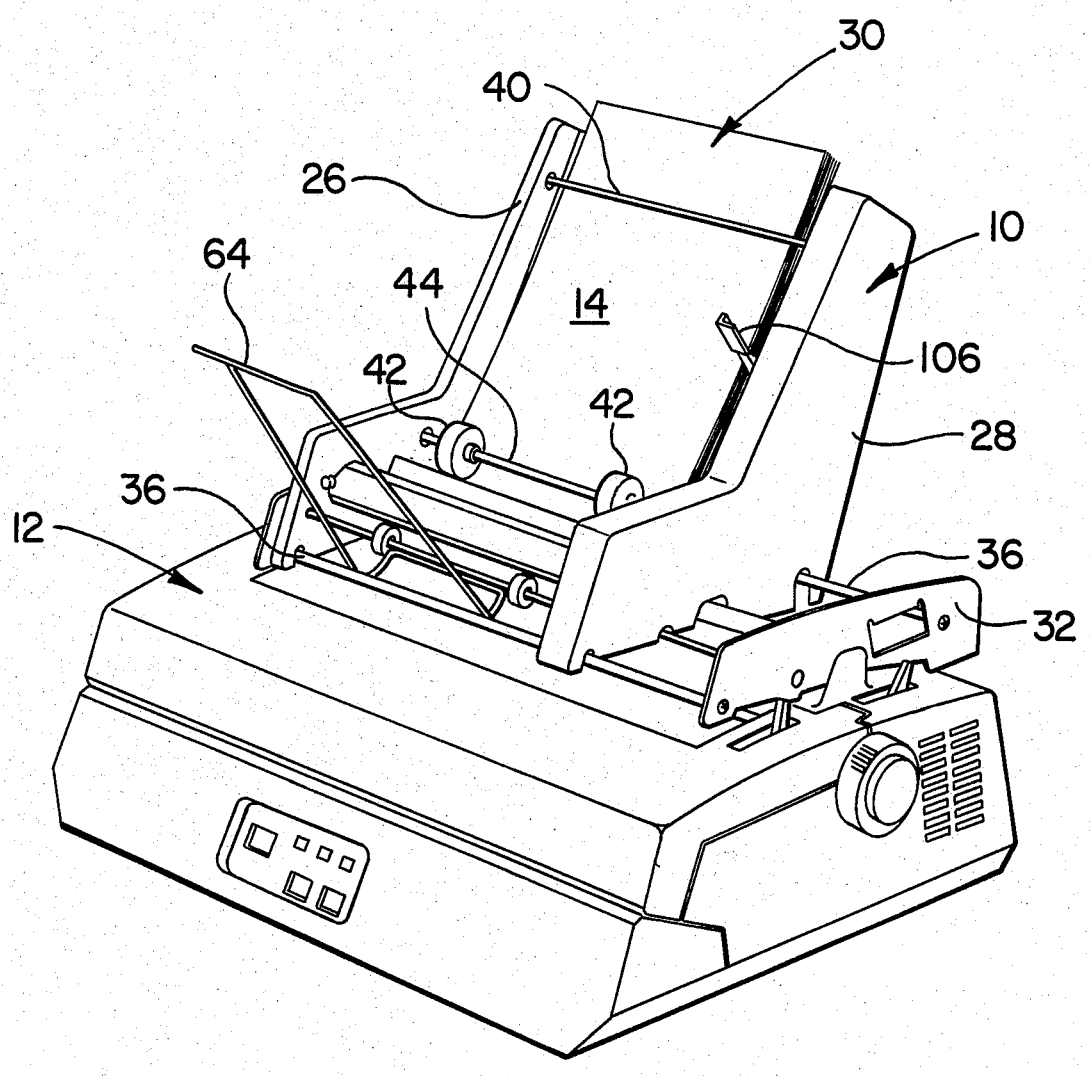
FIG. 1 is a perspective view of a paper sheet feeder incorporating this invention in assembled relation to a computer controlled printer.

Referring now in detail to the drawings, a paper sheet feeder is illustrated at 10 in FIG. 1 suited to be mounted on a printer 12 for printing on a sheet of paper 14. More specifically, it is to be understood that a movable print head, not shown, traverses back and forth across a platen 16 (FIG. 2) rotatable about a transversely extending platen shaft 18. In accordance with conventional techniques, a sheet to be printed on is received between platen 16 and a paper guide 20, appropriate pressure rollers 22 and 24 maintaining the sheet in engagement with the platen 16. The print head is carried by a movable carriage, not shown, which traverses the platen 16 by means of a suitable carriage motor, not shown. The print head may be arranged to be closely spaced from platen 16 so that printing is achieved on the sheet as the print head traverses between opposite ends of platen 16. It will be understood that different arrangements can be provided for the print head, and the printing operation itself may be varied as in a conventional typewriter which prints only from left to right or the printing may be from left to right for one line of print and the succeeding line of print being from right to left as provided by many existing word processing systems.

Automatic word processors have control capabilities for controlling words in one line of printing and automatically advancing platen 16 and the sheet for printing of the next line. The menu of the word processor provides desired margin settings for the size paper being printed. As is known, different prnter switch setting are established for different lengths of paper. By keying off the word procesor menu, each paper sheet may be delivered to platen 16 in a so-called "top of form" or "start-to-print" position in response to a predetermined movement of platen 16. Conventional printers and typewriters write six lines per inch at single spacing which means 84 lines for an 14 inch page. Thus, if the word processor cycling control is set to start printing a new page every 90 lines and the feed of the page is started every 15 inches, the print will be disposed at the same position on every sheet in start-to-print position.

Feeder 10 includes a pair of parallel upright spaced side frames 26, 28 between which a paper supply hopper 30 is mounted with a stack of sheets 14 to be fed to printer 12. Side frames 26, 28 are joined together and support an outboard mounting bridge 32 for mounting feeder 10 onto printer 12 so as to be in proper position for feeding paper sheets to platen 16.

Mounting bridge 32 is attached to feeder side frames 26, 28 by a pair of laterally extending parallel mounting rods 34, 36 and will be understood to have a suitable latch, not shown, for releasably securing feeder 10 to printer 12 so that the paper feed path of feeder 10 is properly aligned with the paper moving platen 16 of printer 12. Sheets are placed on a suitable tray, not shown, supported by plate 38 (FIG. 2) of hopper 30 and may be retained in position by a spring loaded back plate, not shown, and an upper crossbar 40 (FIG. 1) overlying the top sheet 14 to be fed.

To effect paper feed, a leading edge of top sheet 14 engages a pair of spaced feed rolls or rollers 42, 42 fixed on a transversely extending output shaft 44 supported for rotation by side frames 26, 28. A drive shaft 46 is mounted in spaced parallel relation to output shaft 44 and journalled for rotation on feeder side frames 26, 28. As best seen in FIG. 4, a pair of pulleys 48, 48 are spaced apart in fixed relation to drive shaft 46 and positioned between a transversely extending output guide 50 and input guide 52 (FIG. 3) which in part define the paper sheet feed path and will be understood to be fixed at their opposite ends to side frames 26, 28.

Figures 2, 2A:
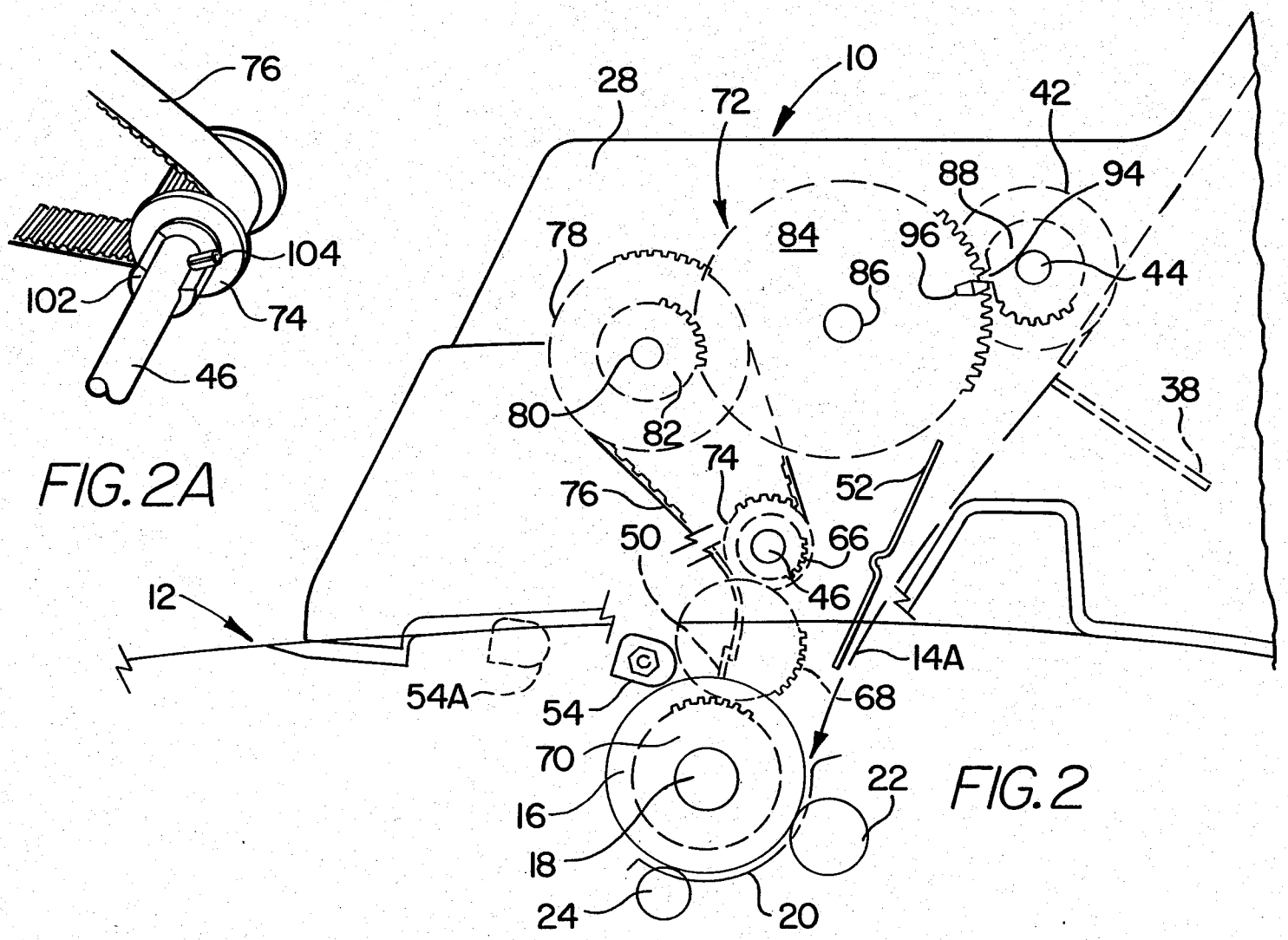
FIG. 2 is a side view, partly broken away and partly in section, showing certain components of the feeder and printer of FIG. 1 with parts removed for illustrative clarity.
FIG. 2A is an enlarged isometric fragmentary view of a drive connection of the mechanism of FIG. 2.
Figure 3:
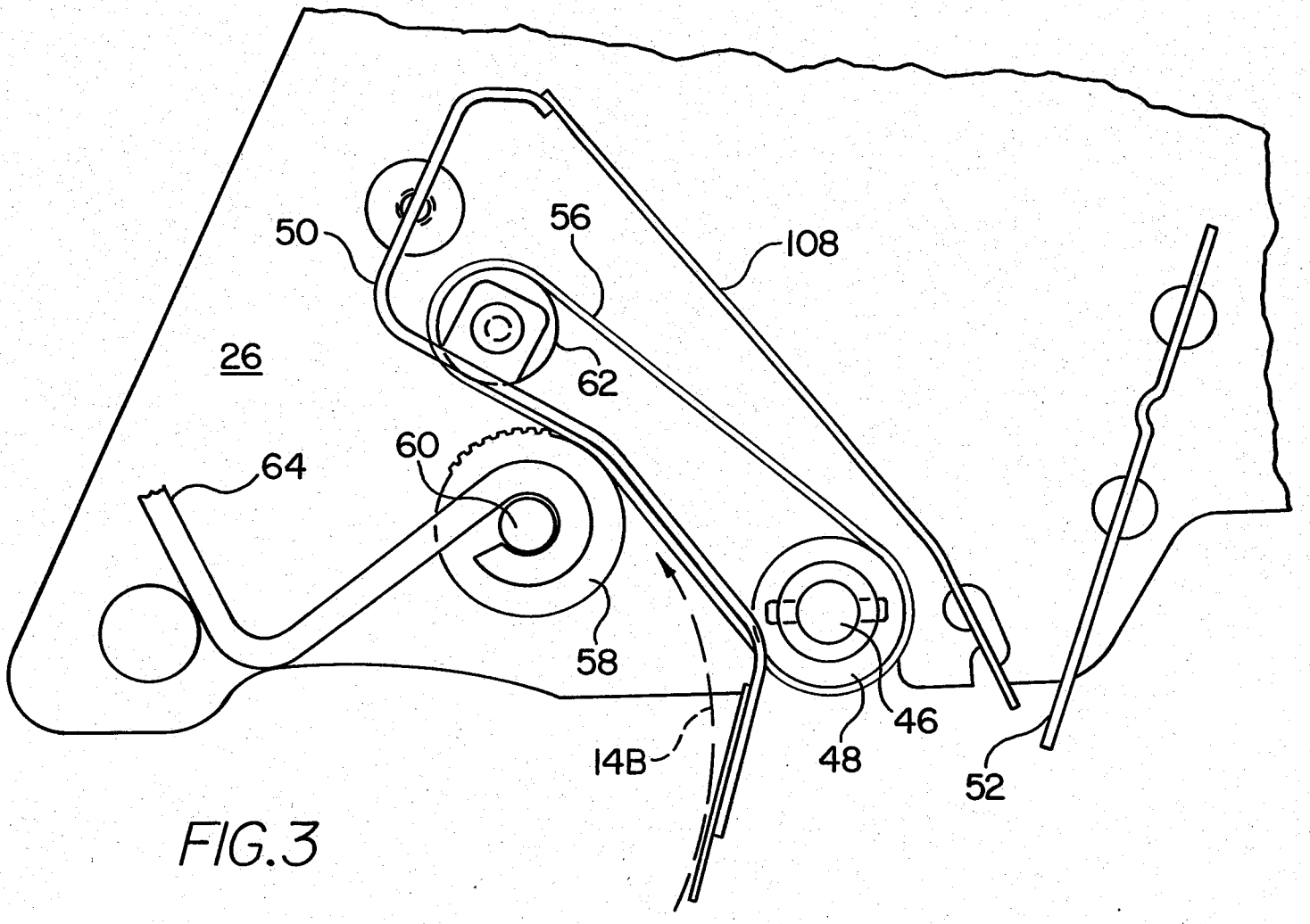
FIG. 3 is an enlarged side view of the feeder of FIG. 1, partly broken away and partly in section, showing a portion of the paper feed path.
Figure 4:
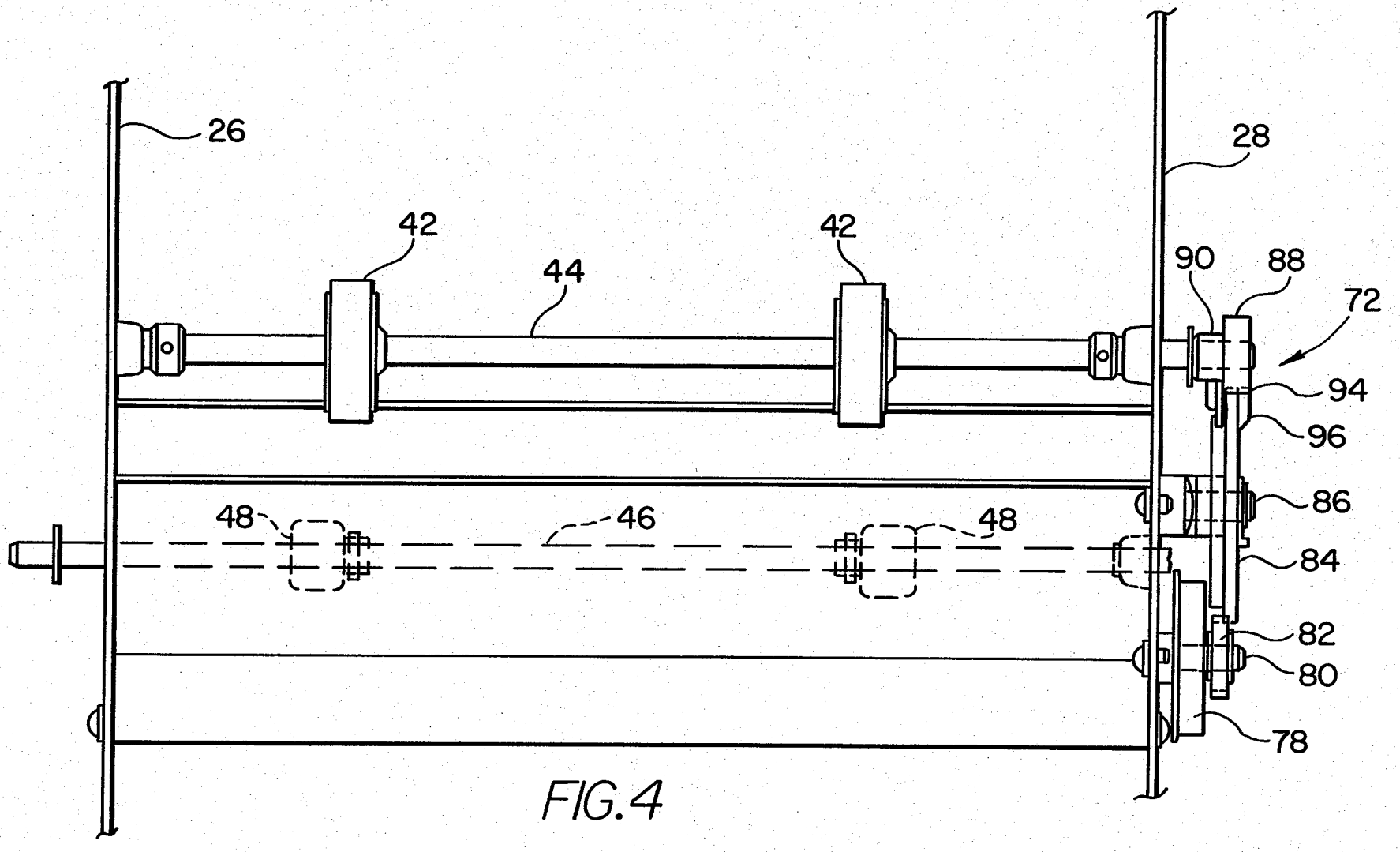
FIG. 4 is an enlarged plan view, partly broken away, of certain components of the feeder timing mechanism.

As best seen in FIGS. 2 and 3, the paper feed path from hopper 30 is directed behind input guide 52 and between platen 16 and its rollers 22 and 24, by means of guide member 20 along the path depicted by broken arrow 14A in FIG. 2. A pivotable paper bail is schematically shown in broken and full lines at 54A and 54 (illustrative of its ready and operative positions for maintaining the sheet in contact with platen 16). Downstream of platen 16, output guide 50 directs paper sheet from between platen 16 and bail 54 to move (as best shown by broken line arrow 14B in FIG. 3) between a pair of drive belts 56 (only one shown) and a pair of serrated friction rollers 58 (only one shown). Rollers 58 are mounted on shaft 60 supported by side frames 26, 28. Belts 56 are trained between the pair of crowned pulleys 48, 48 fixed to drive shaft 46 and a corresponding pair of pulleys 62 (only one shown in FIG. 3) suitably mounted on output guide 50. A stacker bail 64 is illustrated as being supported on shaft 60 for receiving and stacking printed sheets from printer 12 in proper collation sequence.

To provide solely mechanical interfacing between feeder 10 and printer 12, a pinion 66 (FIG. 2) is fixed to drive shaft 46 in meshing engagement with an idler gear 68 supported for rotation on mounting bridge 32. Idler gear 68 is in mesh with a drive gear 70 fixed to platen drive shaft 18 upon proper mounting of feeder 10 on printer 12 with bridge 32 latched to platen shaft 18.

To actuate sequential feeding of individual paper sheets 14 along the above described feed path and to effect precision positioning of each individual sheet 14 so fed into start-to-print position in synchronism with a start-to-print cycling control, e.g., of a word processor printer such as at 12, a mechanical timing mechanism 72 is provided in accordance with this invention particularly suited to be driven by the motion of the printer platen 16 for initiating rotation of feed rollers 42, 42 simultaneously with the start of each operating cycle of the printer platen drive. The timing mechanism 72 functions to time an operable interval for feed rollers 42, 42 less than a full operting cycle of the platen drive which is based upon a predetermined angular displacement of printer platen 16.

More specifically, feed rollers 42, 42 are initially actuated by timing mechanism 72 to feed a single paper sheet 14 into the bite of platen 16 and its rollers 22, 24 and thereafter to terminate feed roller rotation under the driving power of shaft 44, whereupon platen 16 assumes continued drive of each individual sheet 14 during its respective operating cycle. I.e., the effective drive to feed rollers 42, 42 is interrupted by timing mechanism 72 of this invention to terminate powered feed roller drive and release each sheet 14 for movement under the influence of uninterrupted power operation of the printer platen drive. Rollers 42, 42 are each preferably provided with an overriding clutch, not shown, to permit rotary movement of rollers 42, 42 on stationary shaft 44 during continued paper feed under the power of the printer platen drive.

The platen operating cycle is selected to rotate platen 16 through an angular displacement greater than the predetermined page length. For example, angular displacement of printer platen 16 may be a 15 inch net angular platen travel in a feeding direction for a 14 inch paper sheet. The word processor printer 12 need only be keyed to set the page lengths to the proper number of lines. As previously noted, conventional typewriters or printers print six lines per inch single spacing, which is 84 lines for an 14 inch page. Were the word processor set to start printing a new page every 90 lines ($6\times15=90$), and initial feeding of each sheet 14 were started every 15 inches, the print will begin at the same position on each sheet 14 delivered to printer 12.

It is to be understood that the specific timing mechanism 72 of this invention may be provided in a variety of differnt embodiments. For example, a timing gear could be provided with interrupted teeth or cammed in and out of engagement or drivingly connected to a timing belt with timing cogs. In essence, the concept of using mechanical motion of printer platen 16 and its drive shaft 18 to provide a synchronizing signal to a feed start function of feeder 10 of this invention is critical to achieving the disclosed mechanical interfacing, which is so simplified as to be seemingly incompatible with the existing sophisticated state of the art printers. However, feeder 10 not only has been found to perform exceedingly satisfactorily but the disclosed simplified approach reflected by this invention has also been found to achieve enhanced sheet feeding reliability and significantly reduced manufacturing costs.

In the disclosed construction, rotary movement of drive shaft 46 is transmitted by a grooved pulley 74 supported on shaft 46, via a timing belt 76 to a grooved pulley 78 supported for rotation on side frame 28 of feeder 10. Rotary movement of grooved pulley 78 is transmitted by way of a common shaft 80 to a coaxially mounted gear 82 of reduced diameter meshingly engaged with a timing or timer gear 84, of enlarged preselected diameter, supported for rotation by stub shaft 86 on side frame 28.

Figure 6:
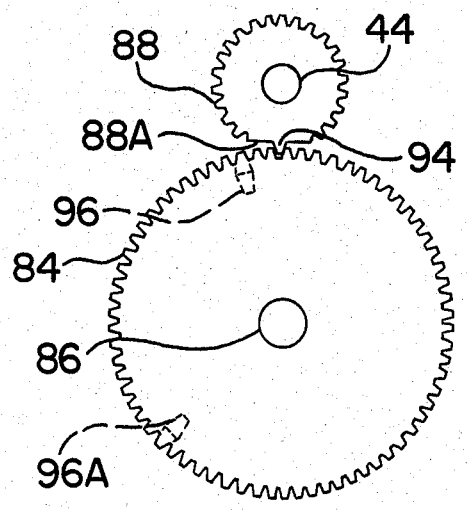
FIG. 6 is an enlarged view taken generally along line 6—6 of FIG. 5.

Accordingly, platen rotary movement is simultaneously transmitted to timer gear 84 through the above described gear train, and timer gear 84 in turn is normally rotatable relative to a mutilated gear 88 supported on output shaft 44 with timer gear 84 rotating through a toothless rim sector 88A (FIGS. 2 and 6) of mutilated gear 88.

Figure 5:
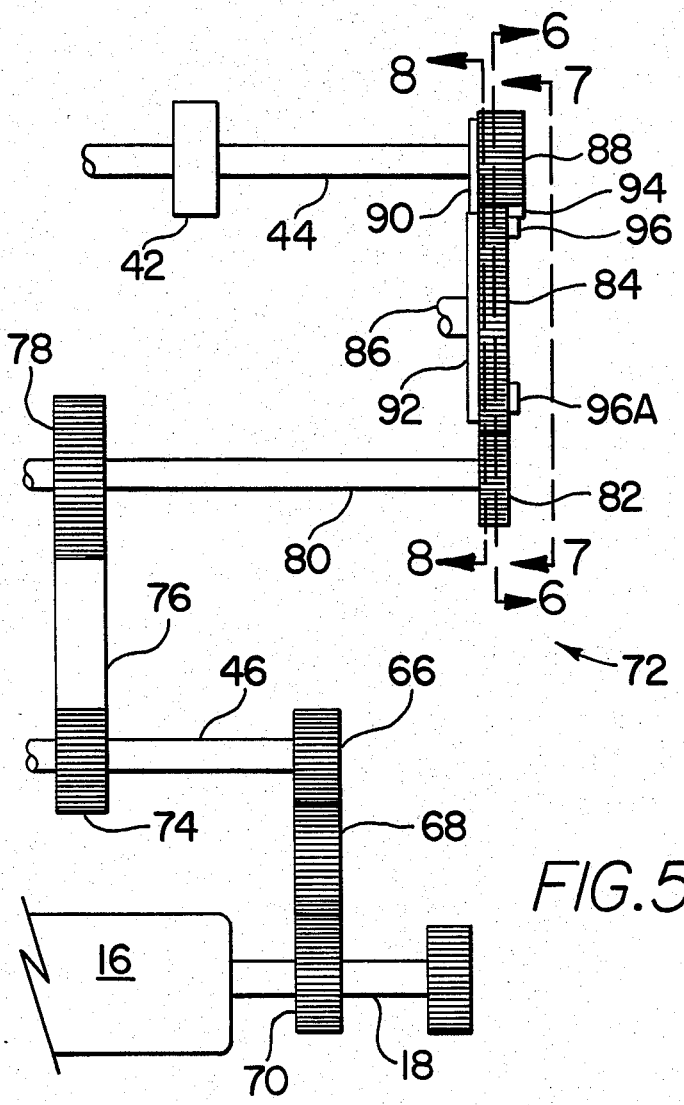
FIG. 5 is a schematic view of certain components of the feeder timing mechanism.

To maintain mutilated gear 88 in a normal ready position in stationary relation to rotating timer gear 84, an axially offset locking arm 90 is integrally formed (FIGS. 5 and 8) on an inboard face of mutilated gear 88 with an arcuate terminal end 90A of arm 90 registrable with an axially offset rim 92 on an inboard face of timing gear 84.

To provide intermittent rotation of output shaft 44 and corresponding intermittent rotation of feed rolls 42, 42 to initiate feeding of a single top paper sheet 14 from hopper 30 into driving engagement with platen 16, mutilated gear 88 is provided with a fixed, axially offset, radial extension 94 (best seen in FIGS. 2 and 6) engageable with a pair of teeth or protrusions 96, 96A integrally formed on timer gear 84 in axially offset relation thereto. Fixed radial extension 94 is integrally formed on a face of mutilated gear 88 opposite that carrying locking arm 90 and in radially aligned symmetrical relation to locking arm 90 (FIG. 8).

In the specifically illustrated embodiment, timer gear rim 92 is profiled to form an arcuate rim portion 92A of reduced radius relative to rim 92 and a pair of angularly spaced radially directed shoulders 98, 100 interconnecting opposite ends of rim portion 92A to rim 92. Upon timer gear 84 rotating in an angular direction denoted by arrow 90 (FIGS. 7 and 8), timer gear protrusion 96 and extension 94 of mutilated gear 88 engage, and mutilated gear 88 rotates in mesh with gear 84 to drive output shaft 44 and feed rolls 42, 42 through a preselected angular movement with end 90A of locking arm 90 received for rotation between shoulders 98, 100 of rim portion 92A. In the described embodiment, arm 90 is returned into registration with timer gear rim 92 upon a trailing end of locking arm 90 engaging shoulder 100 to thereby return mutiliated gear 88 into its normal ready position with end 90A of arm 90 in registration with rim 92 and the toothless rim sector 88A receiving timer gear 84 for continued relative rotation. In the described operation, radial protrusion 96A of timer gear 84 bypasses the extension 94 of mutilated gear 88.

Figure 7:
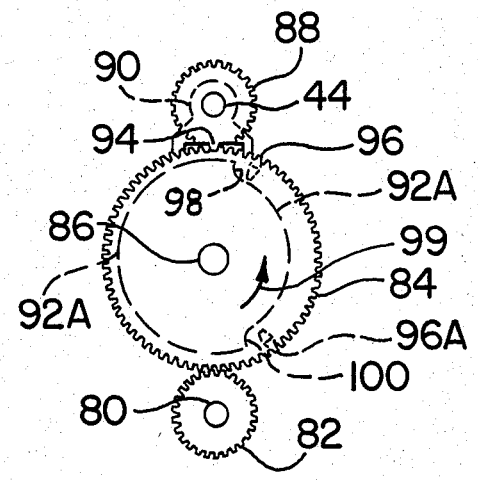
FIG. 7 is an enlarged view taken generally along line 7—7 of FIG. 5.
Figure 8:
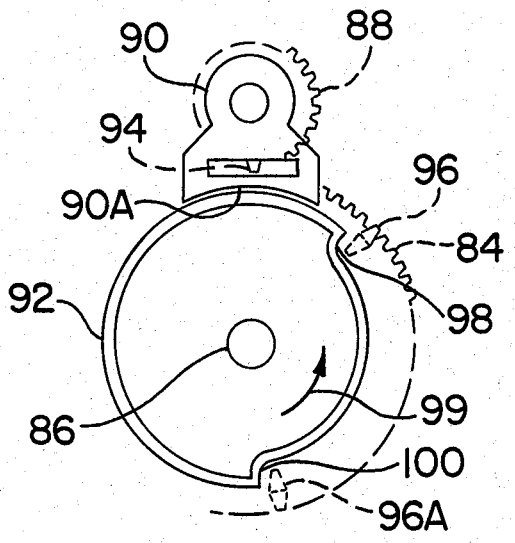
FIG. 8 is an enlarged view taken generally along line 8—8 of FIG. 5.

To provide a bi-directional feature without any undesired mechanical lock-up were timer gear 84 rotated in a direction opposite that shown by arrow 99 in FIGS. 7 and 8, radial protrusion 96A serves to engage extension 94 of mutilated gear 88 to rotate that gear in mesh with timer gear 84, whereby locking arm 90 rotaes through the rim opening between shoulders 100, 98 before gear 88 returns to its normal ready position.

By virtue of the above described construction, feed rolls 42, 42 are intermittently power actuated during continuous uninterrupted powered operation of drive shaft 46 under the influence of drive gear 70 fixed to rotating platen shaft 18. The powered operable interval of feed rolls 42, 42 during the initial portion of each operating cycle is sufficient to rotate feed rolls 42, 42 through a single revolution and to drive a sheet 14 into the bite of platen 16 and its rollers 22, 24 whereupon platen 16 thereafter assumes continued sheet feed during an operating cycle. In the preferred embodiment, the gear train of timing mechanism 72 may be preselected to provide a single revolution of timing gear 84, say, for each 15 inch net displacement of platen 16.

From the foregoing description, it will be understood that an operator initially advances platen 16 manually or by a form feed button of printer 12, if available, until feed rollers 42, 42 cease rotation. A paper stack is then loaded in hopper 30; platen 16 is again manually advanced until a paper sheet 14 is at a desired start-to-print position; and the word processor is actuated to print. Thereupon the word processor will start a new page, if the setup is as described above, say, every 90 lines, and feeder 10 will deliver a new page every 90 lines. The described apparatus will minimize any error and will not accumulate such error. If a sheet 14 should slip a line or two at the start of feed, the print will be a line or two high on that paper sheet but the next sheet will be back on track if it is properly fed without any such slippage.

To permit limited reverse platen movement for printing subscripts, superscripts and plotting, limited reverse movement of feeder drive shaft 46 is accommodated by a pin and collar drive on feeder drive shaft 46 whereby a lost motion connection is established to permit the drive to the feed rolls 42, 42 to remain stationary within limits during reverse platen and feeder drive shaft movement.

For this purpose, as best seen in FIG. 2A, collar 102 is split and is fixed to toothed gear 74 rotatably supported on feeder drive shaft 46. Drive pin 104 is fixed in radially extending relation to feeder drive shaft 46 and received within the collar opening. Upon engaging the split collar 102, pin 104 rotates collar 102 and gear 74 to drive timing belt 76 and the downstream gear train leading to feed rolls 42, 42 of timing mechanism 72.

For increased flexibility in use, single paper sheets or individual envelopes can be loaded into printer 12 while feeder 10 is installed. A loading lever 106 (FIG. 1) on hopper 30 is actuated to render feeder 10 inoperative and printer 12 is cycled to clear any paper from the printer 12. With a release lever, not shown, the paper bail is moved into its position 54A (FIG. 2). Thereafter, single envelopes or sheets are manually inserted between input guide 52 and a confronting envelope guide 108 (FIG. 3) until the paper contacts platen 16 and its guide 20 whereupon the platen 16 may be manually moved in a conventional manner to bring the sheet into start-to-print position prior to printing of that sheet.

By virtue of the above described construction, it will be understood that feeder 10 of this invention is particularly designed to work mechanically, using only platen motion, to time a unidirectional sheet feeding in contact with a word processing program. The described simplicity of the disclosed construction serves to insure a high degree of reliability under normal operating conditions providing exceptional performance with minimum down time and attendant service requirements.

As will be apparent to persons skilled in the art, various modifications, adaptations and variations of the foregoing specific disclosure can be made without departing from the teaching of this invention.

I claim:

1. For use in controlling sequential feeding of individual paper sheets along a paper feed path from a paper storage hopper to a computer controlled printer wherein each individual paper sheet is accurately moved by a power operated platen into a printing position for the start of printing thereon in synchronism with a start-to-print cycling control of the word processor printer, a mechanical timing mechanism comprising sheet engaging feed means upstream of the word processor printer, and drive means drivingly connected between the platen and the feed means for operating the feed means, the drive means being continuously operable in uninterrupted repetitive operating cycles responsive to uninterrupted unidirectional operation of the platen, the drive means including mechanical timing means for intermittently actuating the feed means responsive to said uninterrupted operation of the printer drive for sequentially driving individual paper sheets a preselected distance in one direction along the paper feed path in timed relation to the printer operation.

2. The mechanism of claim 1 wherein the platen is located downstream of the feed means, and wherein the timing means initiates and interrupts operation of the feed means solely in response to movement of the platen.

3. The mechanism of claim 2 wherein the platen is drivingly engageable with successive paper sheets for moving the same through the paper feed path, the timing means interrupting operation of the feed means upon the platen drivingly engaging each paper sheet.

4. The mechanism of claim 2 wherein the mechanical timing mechanism drive means further includes a lost motion drive connection to the feed means permitting limited reverse platen movement with the feed means in stationary condition.

5. The mechanism of claim 2 wherein the feed means includes rotary feed rolls, wherein rotation of the feed rolls through a predetermined angular displacement in one direction drives each individual paper sheet said preselected distance from the hopper and into driving engagement with the platen during an operable interval established by the timing means.

6. The mechanism of claim 5 wherein the drive means operates during a time interval of each operating cycle greater than said operable interval of the feed rolls, said time interval of the drive means being greater than that required to drive a predetermined length of paper sheet from the hopper to the word processor printer, thereby providing identical paper sheet start-to-print positioning in the word processor printer.

7. The mechanism of claim 1 wherein the platen is drivingly connected to the timing mechanism drive means and provides the sole power required for operating the drive means in timed relation to the printer operation.

8. The mechanism of claim 1 wherein the drive means is operable in said uninterrupted repetitive operating cycle for respectively moving individual sheets of paper through the paper feed path, the timing means automatically actuating the intermittently operable feed means upon initiation of each operating cycle for removing from the hopper an individual paper sheet for delivery by the drive means to said printing position in the word processor printer, the timing means interrupting powered operation of the feed means by the drive means for a part of each operating cycle upon each individual paper sheet being released from engagement by the feed means.

9. For use in controlling sequential feeding of individual paper sheets along a paper feed path from a paper storage hopper to a computer controlled printer wherein each individual paper sheet is accurately moved by a power operated printer drive into a printing positon for the start of printing thereon in synchronism with a start-to-print cycling control of the word processor printer, a mechanical timing mechanism comprising sheet engaging feed means upstream of the word processor printer, and drive means drivingly connected between the printer drive and the feed means for operating the feed means, the drive means including mechanical timing means for intermittently actuating the feed means responsive to uninterrupted operations of the drive means by the printer drive for sequentially driving individual paper sheets a preselected distance in one direction along the paper feed path in timed relation to the printer operation, a supporting frame, the timing means further including a support shaft and an output shaft mounted in parallel relation on the frame, the feed means including rotary feed rolls mounted on the output shaft for rotation therewith, a mutilated gear fixed on the output shaft, the timing means further including a timing gear fixed to the support shaft and drivingly connected to the drive means for rotation in one angular direction, the mutilated gear having a toothless rim portion, the output shaft and mutilated gear being rotable from a stationary ready position wherein the timing gear is received for rotation within the toothless rim portion of the mutilated gear, the timing gear having a fixed radial protrusion and a parti-circular arcuate locking rim concentrically formed thereon with angularly spaced first and second shoulders directed generally radially inwardly at opposite ends of the rim and defining an opening between the shoulders, the mutilated gear having a fixed radial extension engageable with the timing gear protrusion and a fixed locking arm having an arcuate terminal end registrable with the rim of the timing gear in adjacent relation thereto for permitting rotation of the timing gear relative to the mutilated gear.

10. The mechanism of claim 9 wherein the timing gear protrusion and mutilated gear extension are engageable for releasing the mutilated gear from its ready position to drive its locking arm into the opening between the shoulders of the locking rim to rotate the mutilated gear in meshing engagement with the timing gear to drive the output shaft and feed rolls.

11. The mechanism of claim 10 wherein a trailing shoulder of the trailing rotating timing gear is engageable with the locking arm upon its being rotated through one revolution to return the locking arm into registration with the locking rim and to return the mutilated gear into ready position.

12. The mechanism of claim 10 wherein a second radial protrusion is fixed to the timing gear in angularly spaced relation to its first protrusion for engagement with the mutilated gear extension upon rotary movement of the timing gear in a direction opposite said one angular direction for driving the mutilated gear in mesh with the timing gear.

13. The mechanism of claim 9 wherein a base time interval of each operating cycle is established by a single revolution of the timing gear through a predetermined angular displacement greater than the length of the individual sheets being fed to the printer.

* * * * *